US006862756B2

(12) United States Patent
Mathis

(10) Patent No.: US 6,862,756 B2
(45) Date of Patent: Mar. 8, 2005

(54) WALK-ON TRAY FOR CONCEALING A POOL COVER OPERATION SYSTEM

(75) Inventor: Wesley L. Mathis, West Jordan, UT (US)

(73) Assignee: Pool Cover Specialists National, Inc., West Jordon, UT (US)

( * ) Notice: Subject to any disclaimer, the term of this patent is extended or adjusted under 35 U.S.C. 154(b) by 65 days.

(21) Appl. No.: 10/267,285

(22) Filed: Oct. 9, 2002

(65) Prior Publication Data

US 2003/0046805 A1 Mar. 13, 2003

Related U.S. Application Data

(63) Continuation-in-part of application No. 10/118,845, filed on Apr. 8, 2002, now abandoned, which is a continuation of application No. 09/725,636, filed on Nov. 29, 2000, now Pat. No. 6,446,276.

(60) Provisional application No. 60/168,170, filed on Nov. 30, 1999.

(51) Int. Cl.[7] ..... E04H 4/14

(52) U.S. Cl. ..... 4/502; 4/500; 4/496

(58) Field of Search ..... 4/502, 500, 496, 4/501; 52/3, 169.7

(56) References Cited

U.S. PATENT DOCUMENTS 3,019,450 A 2/1962 Karasiewicz
3,050,743 A 8/1962 Lamb
3,076,975 A 2/1963 Lamb
3,351,958 A * 11/1967 Shields ..... 52/169.7
3,584,319 A * 6/1971 Van Den Broek ..... 52/169.7
3,748,664 A 7/1973 Morita
4,120,126 A * 10/1978 West ..... 52/169.7
4,234,973 A 11/1980 Vetter et al.
4,343,118 A * 8/1982 Lankheet ..... 52/169.7
4,815,152 A 3/1989 MacDonald et al.
5,018,324 A * 5/1991 Lankheet ..... 52/169.7
5,044,022 A 9/1991 Hess
5,327,590 A 7/1994 Last
5,913,613 A 6/1999 Ragsdale et al.
5,927,042 A * 7/1999 Last ..... 4/502
6,324,706 B1 12/2001 Epple

* cited by examiner

*Primary Examiner*—Gregory L. Huson
*Assistant Examiner*—Khoa Huynh
(74) *Attorney, Agent, or Firm*—Clayton, Howarth & Cannon, P.C.

(57) ABSTRACT

A walk-on tray apparatus for concealing a pool cover operation system, is disclosed. A plurality of brackets each having a load-bearing upper portion may be attached to a sidewall of an elongate recess formed at one end of a pool, such that the load-bearing upper portions of the brackets extend in a substantially horizontal orientation. A plurality of platform sections each include a mortar veneer, a tray with an attachment plate removably disposed beneath an under side of the tray, and a nut-tightening arrangement, such that the load-bearing upper portions may be securely sandwiched between the under side of the tray and the attachment plate. The platform sections may reside in a side-by-side, sequential series. The mortar veneer may be formed directly on the tray, and the facade may be modified and customized to match the appearance of the perimeter sections of a pool deck. The veneer may be composed of mortar, resin and negligible amounts of fiberglass particles, forming an elastic composition.

74 Claims, 4 Drawing Sheets

WALK-ON TRAY FOR CONCEALING A POOL COVER OPERATION SYSTEM

CROSS-REFERENCE TO RELATED APPLICATIONS

This application is a continuation-in-part application of U.S. patent application Ser. No. 10/118,845, filed Apr. 8, 2002, now abandoned, entitled "WALK-ON TRAY FOR CONCEALING A POOL COVER OPERATION SYSTEM," which is a continuing application of U.S. patent application Ser. No. 09/725,636, filed Nov. 29, 2000, now U.S. Pat. No. 6,446,276 entitled "WALK-ON TRAY FOR CONCEALING A POOL COVER OPERATION SYSTEM," which claimed the benefit of U.S. Provisional Application No. 60/168,170, filed Nov. 30, 1999, which are all hereby incorporated by reference herein in their entireties, including but not limited to those portions that specifically appear hereinafter, and this application therefore claims entitlement to the benefit of said U.S. Provisional Application No. 60/168,170 by virtue of the forgoing chain of priority, and the incorporation by reference is made with the following exception: In the event that any portion of any of the above-referenced applications is inconsistent with this application, this application supercedes said above-referenced applications.

STATEMENT REGARDING FEDERALLY SPONSORED RESEARCH OR DEVELOPMENT

Not Applicable.

BACKGROUND OF THE INVENTION

1. The Field of the Invention

The present invention relates generally to a load bearing, platform-style lid, and more particularly, but not entirely, to a walk-on tray for concealing a pool cover operation system.

2. Description of Related Art

It is known to place the workings of a retractable pool cover system in a recessed enclosure at one end of a pool. The pool cover system would typically include a flexible pool cover wound upon a drum, similar to a roll of carpet, for example. The drum is rotatably stored in the recessed enclosure for dispensing the flexible pool cover onto the pool during periods of non-use, and for retracting the pool cover back upon the drum during periods of use.

The benefits of a selectively dispensable and retractable pool cover are enhanced by recessing the pool cover drum system into the deck at one end of the pool, thereby concealing the drum system from immediate view. These and other benefits are, however, offset by the complication that the recessed pool cover system renders that entire side of the pool inaccessible to bathers, and interrupts the appearance of the pool deck with the workings of the cover system.

Attempts have been made in the prior art to cover the recessed pool cover drum system using removable, concrete or mortar lids. However, these lids have typically been made from large amounts of concrete or mortar to form at least a three inch thick lid, which is very heavy and costly. The weight of the prior art lids complicate both installation and subsequent removal for repairing the recessed pool cover drum system, and the cost to manufacture such lids creates a resulting product that is expensive to produce. Installation is complicated by the fact that heavier brackets are required to hold the lids in place, which brackets are more difficult to install due to the adjustments that are required to align the lid with the surrounding coping of the pool. The complication of installing heavier brackets and thicker concrete lids, results in increased installation time and expense to the customer.

The prior art is thus characterized by several disadvantages that are addressed by the present invention. The present invention minimizes, and in some aspects eliminates, the above-mentioned failures, and other problems, by utilizing the methods and structural features described herein.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1:
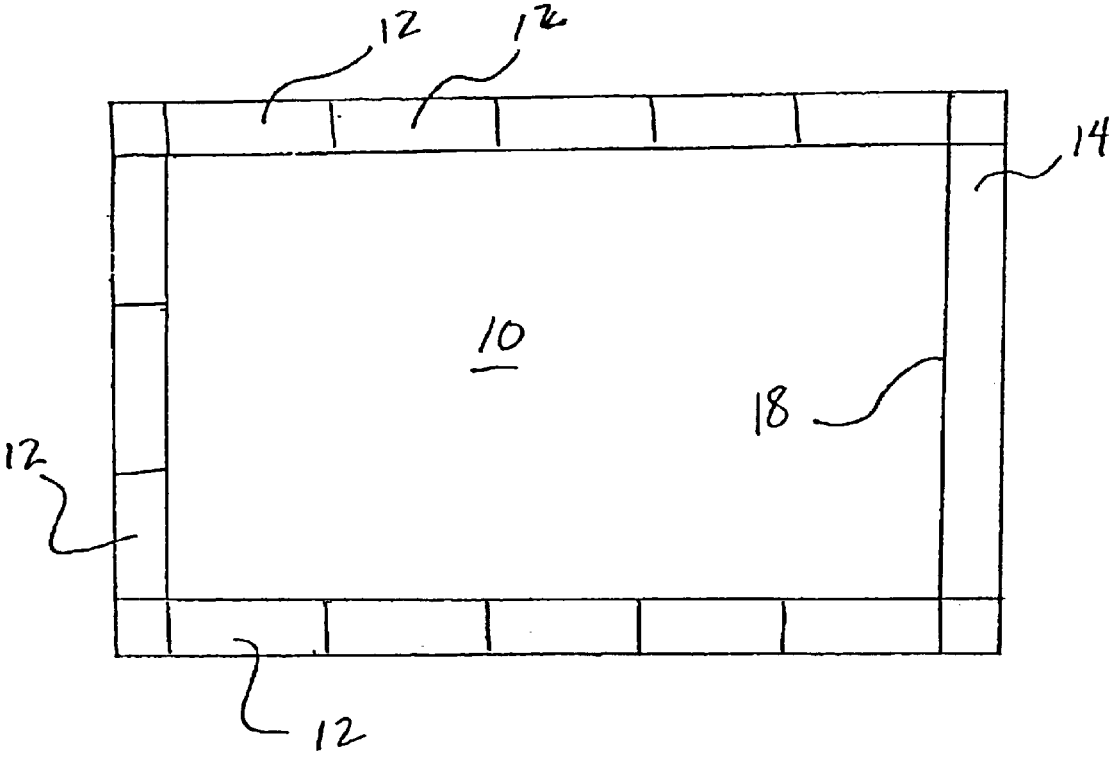
FIG. 1 is a schematic, plan view of a pool with decorative coping sections surrounding the perimeter of the pool.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The invention is directed to a walk-on tray for concealing a recessed pool cover system. FIG. 1 illustrates a plan view of a pool 10, having traditional cementitious decorative perimeter (coping) sections 12 surrounding the perimeter of the pool 10 on three sides. On the fourth perimeter side of the pool 10 is an elongate recess 14 that extends the width of the pool in which a rotational-drum pool cover retraction/placement device (not shown in FIG. 1) resides.

The recess 14 is defined by a sidewall 15 and is formed within the pool deck such that the traditional pool cover retraction/placement device 20 resides below the pool deck surface. Thus, a more aesthetic appearance may be achieved because the pool cover retraction/placement device 20 is completely disposed below the surface of the pool deck.

Whereas other storage components and retainer mechanisms are built above the pool deck surface and result in the loss of useful space where sunbathers or swimmers would otherwise have access.

The prior art devices have used a series platform sections constructed of solid, heavy trays composed of heavy metal to hold a substantial amount of concrete or mortar to form a cover, or platform section, for concealing the recess 14. Typically, each of the prior art platform sections is manufactured from concrete or mortar poured into heavy metal trays about three to four inches thick, or possibly even thicker, and is approximately two feet in length, and therefore the resulting platform section weighs between seventy and eighty pounds or possibly more depending upon the actual thickness of the concrete or mortar and the metal tray used.

However, there are many problems associated with such a heavy covering, for example, such a cover requires the mortar to be poured into heavy metal trays, causing even more weight to be added to the cover, and said trays must be attached to heavy duty, weight-bearing brackets or surfaces that will be able to support the weight of the mortar. All of the above requires additional effort and expense and substantially increases the installation time and procedure. Problems associated with removal of the platform sections are also increased with the increase in weight of the platform sections. Therefore, any necessary repairs of the retraction/placement device 20, which will inevitably require at least one platform section to be removed, becomes very difficult due to the substantial weight of the platform section.

Figure 2:
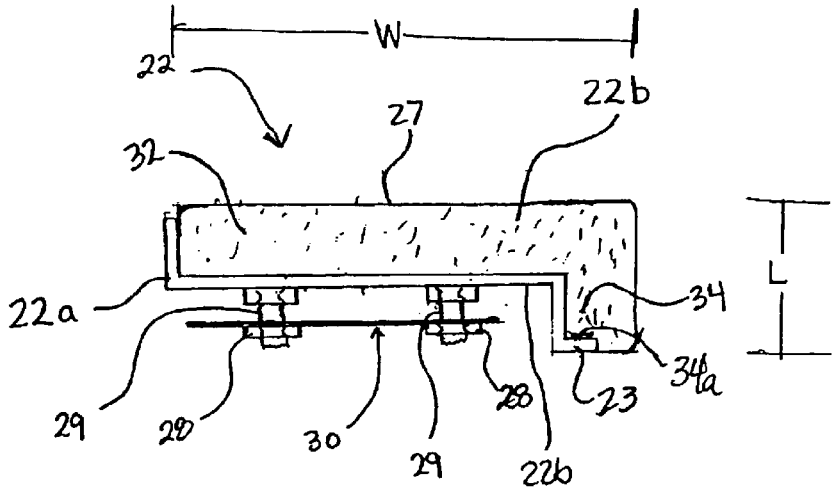
FIG. 2 is a side, break-away view of surrounding concrete forming one side of the pool and illustrating a recess in which resides a rotational pool cover drum system and a walk-on tray, made in accordance with the principles of the present invention, for concealing the pool cover system.
Figure 2:
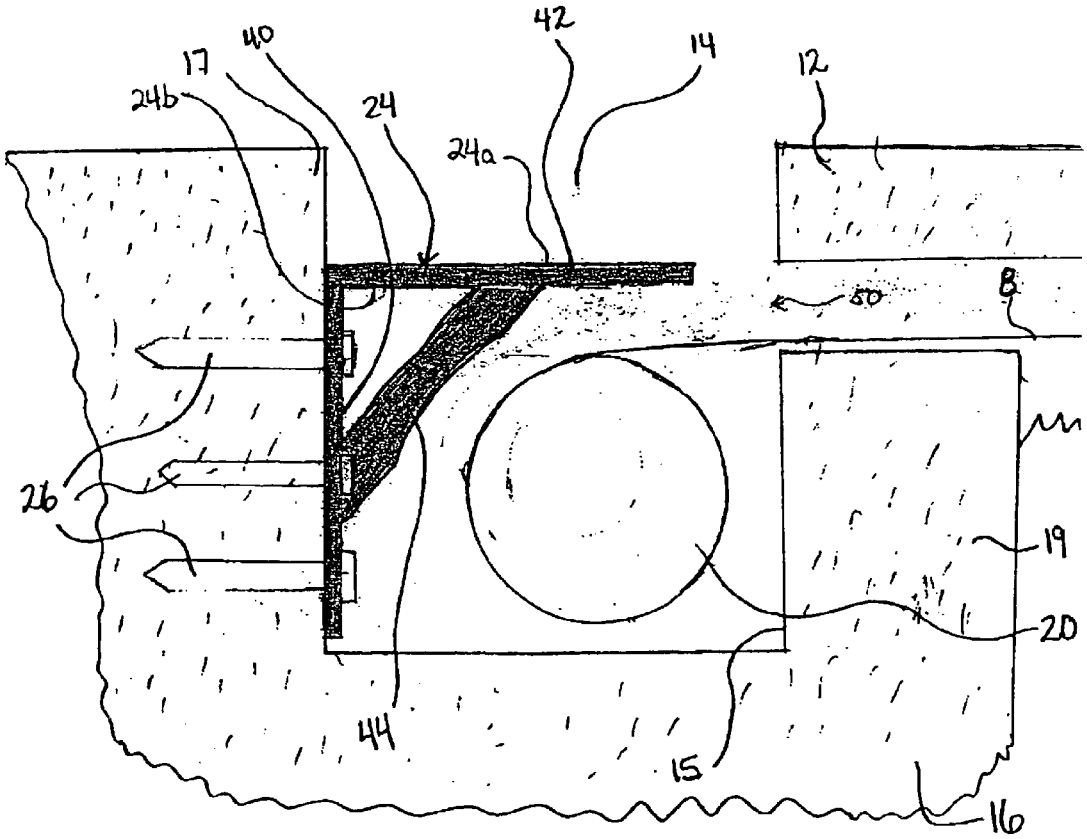

Due to the above problems, Applicant has conceived of a relatively light weight, walk-on tray 22, sometimes referred to herein as a removable lid or a platform section, for aesthetically covering the recess 14, which may be modified to match the surrounding pattern of the pool deck, and is cost effective and easier to install than those devices known in the art. Referring now to FIG. 2, wherein a side, break-away view of the surrounding concrete 16 forming side 18 of the pool 10, and a side view of the recess 14, in which a pool cover retraction/placement device 20 resides, is illustrated.

In the present invention, the elongate recess 14 is covered by several walk-on trays 22, wherein each walk-on tray 22 comprises an aluminum tray 22*a* for receiving and maintaining a mortar veneer 22*b* residing in the tray 22*a*. It should be noted that the tray 22*a* of the present invention may be manufactured from any durable, light-weight material besides aluminum that is known, or that may become known in the future, to those skilled in the art and such materials are intended to fall within the scope of the present invention.

Figure 3:
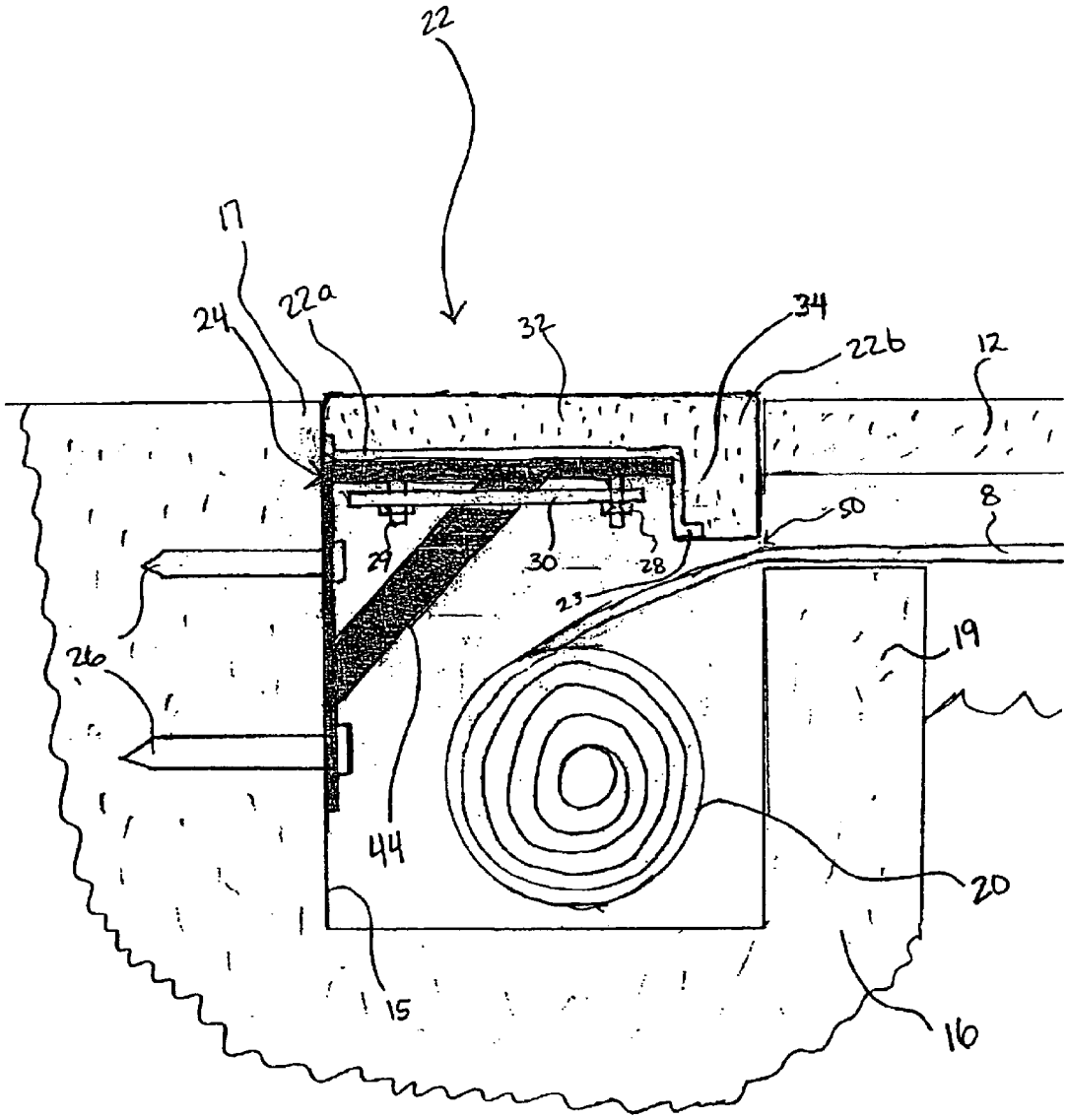
FIG. 3 is a side, break-away view similar to FIG. 2 with the walk-on tray covering a portion of the recess, made in accordance with the principles of the present invention.

As more particularly illustrated in FIGS. 2 and 3, which are side views of the apparatus, the tray 22*a* comprises multiple interconnected walls, including front lip 23 as illustrated in FIG. 2, and may include a grate that is closely nested thereon and shaped by a metal weave having a series of diamond shaped holes (not illustrated in the figures) forming a mesh. The grate of the tray 22*a* functions to capture and suspend the mortar on the tray 22*a* to form a unitary lid or platform section 22, which comprises the tray 22*a*, the metal grate and the mortar composition. It should be noted that the metal grate may be made from any suitable material and shaped in any suitable manner to accomplish the stated function of providing a framework on which the mortar composition may be suspended and maintained.

Also illustrated in FIGS. 2–3, at least one bolt 29 extends from and is attached to the tray 22*a*. As illustrated, the tray 22*a* comprises at least two bolts 29, with at least one bolt 29 at each end of the tray 22*a*. It will be appreciated that four bolts 29 may be used, two bolts at each end of the tray 22*a*, to more firmly attach the walk-on tray 22 to brackets 24. The bolts 29 may be secured to the tray 22*a* by means that are known in the art for securing bolts or fasteners to a tray 22*a*, such as a weld, epoxies, fasteners, nuts, or other such devices. Additionally, other fasteners may be used besides bolts 29 for attaching the walk-on tray 22 to brackets 24 such as screws, rivets, anchors or other fasteners.

The mortar veneer 22*b* is manufactured from a material that has an elastic component and comprises an upper, base portion 32 and a lip-engaging portion 34. The top surface of the base portion 32 may be modified to match the surrounding coping of the pool deck. Such modification may be performed to match the surrounding pool deck and accomplished through a process known as stamping, which creates a decorative exterior finish on the mortar composition, or other process known, or which may become known in the future, in the art for modifying the surface of the mortar veneer 22*b*. Such modifications may sometimes be referred to herein as a means for modifying an appearance of an upper portion of the platform sections to match an appearance of a perimeter section of a pool deck. It should be noted that the present invention permits each platform section 22, as well as the mortar veneer 22*b*, to be customized in both size and shape to match the appearance of the coping sections 12 surrounding the other sides of the pool 10.

The lip-engaging portion 34 extends downwardly from the base portion 32 for a predetermined length, such that said lip-engaging portion 34 has a length "L" as represented in FIG. 2. The length "L" of the lip-engaging portion 34 corresponds substantially to the difference in height between a bond beam 19, which borders the pool on one side and the recess 14 on the other, and the back 17 of the recess 14 to which a bracket 24 is attached. The length "L" of the lip-engaging portion 34 may be between the range of about 10% to about 40% of a width "W" of the top surface 27 of the base portion 32. For example, if the length "L" of the lip-engaging portion 34 is approximately 3 inches, the width "W" of the top surface of the base portion could be approximately 12 inches, such that the length "L" of the lip-engaging portion 34 is 25% of the width "W" of the base portion 32. It should be noted that the above is merely one example of the many combinations of lengths "L" and widths "W" that may be used by the present invention.

The length "L" of the lip-engaging portion 34 may, if desired, may be within a range of two inches to eight inches, or any dimension in between, or any other suitable dimension desired outside of the foregoing specified range. The width "W" of the base portion 32 may, if desired, may be within a range of at least ten to forty inches, or any dimension in between, or any other suitable dimension desired outside of the foregoing specified range.

The lip-engaging portion 34 may be configured and dimensioned to extend downwardly from the pool deck surface to nearly the top surface of the bond beam 19, and in one embodiment does not extend completely down to touch the bond beam 19, creating a gap 50 for the pool cover to slide beneath the lip-engaging portion 34. The lip-engaging portion 34 includes a lip-abutting portion 34*a* which abuts the lip 23 of the tray 22*a*. In one embodiment, the lip-abutting portion 34*a* and lip 23 are parallel to tray-base 22*b* of the tray 22*a*.

Once the platform section 22 is attached to the bracket 24, the gap 50 allows the pool cover 8 to slide unobstructed beneath the lip-engaging 34 and attach onto the pool cover retraction/placement device 20. Thus, the extension of the lip-engaging portion 34 of the walk-on tray 22 simulates the thicker platform sections of the prior art, but is, in fact, only a facade. Advantageously, the facade reduces the amount of mortar or concrete used in the walk-on tray 22 and substantially reduces the overall weight of the walk-on tray 22 allowing greater flexibility for the walk-on tray 22, and increases the ease of installation.

Another factor in reducing the weight of the platform section 22 is due to the composition itself, which comprises a mixture of about forty (40%) to sixty (60%) percent mortar and about forty (40%) to sixty (60%) percent resin. Illustratively, fifty percent (50%) mortar and about fifty percent (50%) resin may be used. In any event a negligible amount of fiberglass particles may be optionally used for increasing elasticity of the mortar-resin composition. It should be noted that the resin may be comprised of fiberglass or thermoplastic materials such as polyvinyl, polystyrene, and polyethylene as well as other materials known in the art to increase the elasticity of the mortar-resin composition. The resulting elasticity of the mortar-resin composition allows the walk-on tray's 22 veneer 22*b* to be poured using a very thin layer of mortar, which may be less than two inches thick. Illustratively, the thickness may be between the range of 0.4 to 1 inches thick.

It is to be understood that the elasticity of the mortar-resin composition may also aid thicker mortar veneers as well and the thickness of the veneer 22*b* is not limited to the range previously described, but the given range is merely an illustrative example of how thin the veneer may be poured. The composition allows the resulting mortar veneer 22*b* to be substantially more elastic than ordinary mortar and allows the composition to expand and contract while inhibiting cracking, chipping or breaking out of the composition from the tray 22*a*.

It is to be understood that the composition described above used in conjunction with the lip-engaging portion 34 allows the walk-on tray 22 to be much lighter and thinner than the heavier, thicker concrete pieces that are known in the art, without losing any of the aesthetically pleasing appearance. Additionally, the walk-on tray 22 may experience further weight reduction using aluminum or stainless steel trays 22*a*. Among the improvements provided by the present invention are the concepts of 1) a thinner and lighter weight walk-on tray 22 than previously known in the art, which corresponds to an improved, simpler mode of attachment to the bracket 24 referred to below; and 2) a lip-engaging 34 that simulates the thicker, heavier trays known in the art, while providing the aesthetic appearance of the heavier trays.

The mortar veneer 22*b* may be molded using wood or other material as forms, which are placed around the perimeter of the tray 22*a* for casting the mortar-resin composition into the tray 22*a*. The mortar-resin composition is then poured into the forms and allowed to cure, after which the wood forms may be removed resulting in a complete walk-on tray 22. The above process allows each platform section to be made in a unique manner to conform to the specifications and dimensions of the surrounding pool coping. Thus, because every job is unique, the above process allows each job to be custom made and custom fit without the expense of traditional custom work. It should be noted that other methods of casting the veneer 22*b* on the tray 22*a* may be used to accomplish the same result without departing from the scope of the present invention.

Figure 4:
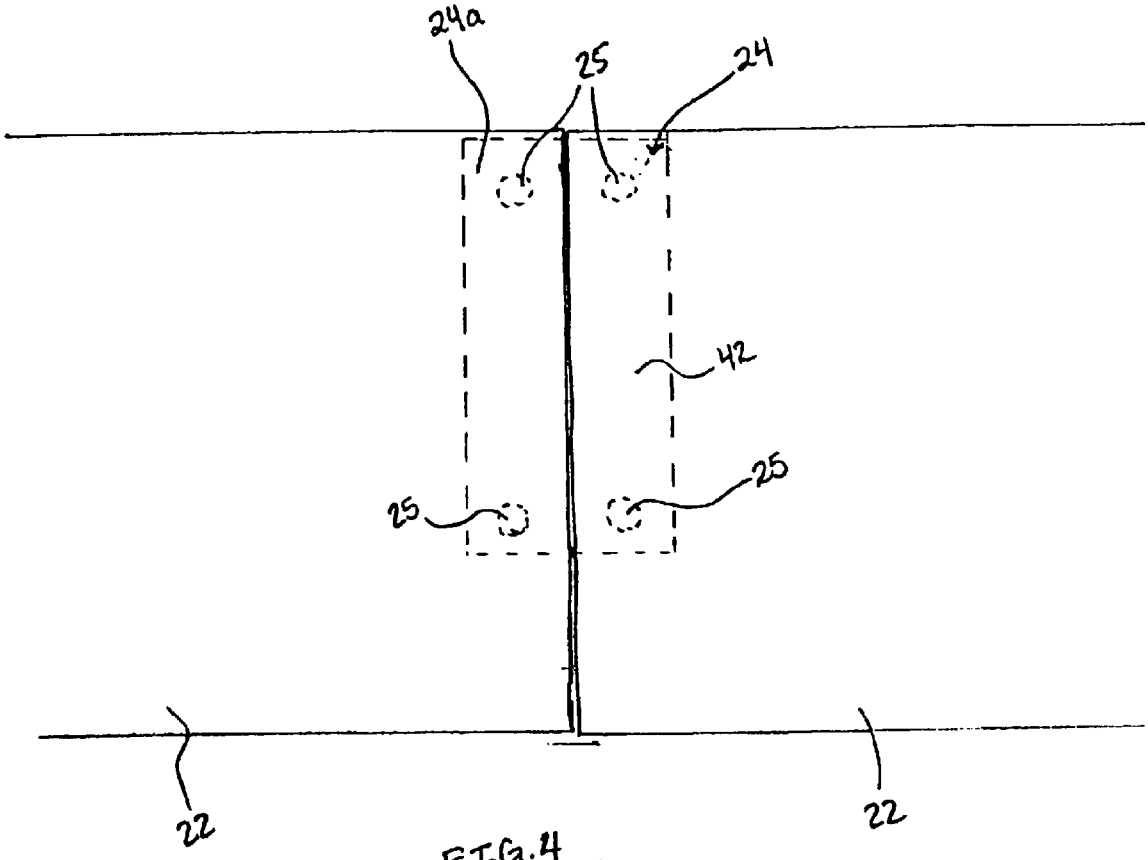
FIG. 4 is a top view of the walk-on tray made in accordance with the principles of the present invention and illustrating the placement of two abutting walk-on trays on a single bracket.

The resulting walk-on tray 22, may be attached to the pool deck using a plurality of brackets 24 secured to the recess 14 of the pool deck by bracket attachment means, which may be for example screws, bolts, anchors, rivets, or other fasteners. Each bracket 24 comprises a load-bearing upper portion 42 having a top surface 24*a* and a bottom surface 24*b*. The load-bearing upper portion 42 extends substantially horizontally from a base portion 40, also referred to herein as a longitudinal portion, such that the load-bearing upper portion 42 is substantially parallel with the pool deck. Bracket 24 further comprises a brace arm 44 being disposed between the base portion 40 and the load-bearing upper portion 42 at a diagonal. The brace arm 44 supplies the support necessary for the upper portion 42 to bear a load, such as the platform section 22. It should be noted that the brace arm 44 may or may not be present on the bracket 24 depending upon the loads that must be carried by said bracket 24. The top surface 24*a* is configured and dimensioned to support an end of each of two separate platform sections 22, as shown most clearly in FIG. 4. The width of the top surface 24*a* of the bracket 24 may be any width to accomplish the above purpose, and is illustrated in FIG. 4 as being about one to two inches, such that each end of the two separate walk-on trays 22 rests on the top surface 24*a* of the bracket 24 about ½ to 1 inch, such that the two ends of the walk-on trays 22 abut each other.

Brackets 24 contain through holes 25 on the top surface 24*a* of the load-bearing upper portion 42 such that the bolts 29 of the platform section 22 may extend therethrough to aid in the attachment of the platform section 22 to the bracket 24. Once, the platform section 22 is attached to the brackets 24, as will be described in more detail below, brackets 24 function to support the weight of the platform sections 22. Brackets 24 may be secured by a bracket attachment means for attaching the brackets 24 to the sidewall of the elongate recess 14 such that the load-bearing upper portions 42 of said brackets 24 extend in a substantially horizontal orientation, and said bracket attachment means may be generally referred to at 26.

The walk-on trays 22 may be placed side-by-side over the recessed area 14 and are attached to brackets 24 such that the platform sections 22 cover the recess 14. Specifically, each platform section 22 is configured and dimensioned to reside on the load-bearing upper portion 42 of the bracket 24 in such a manner so that the platform section 22 covers approximately half of the load-bearing upper portion 42, as described above. Thus, when each platform section 22 is placed side-by-side, the two ends of each platform section 22 abut one another to form a substantially continuous surface.

A simple, loose attachment plate 30 may be used to ultimately attach the walk-on tray 22 to the brackets 24. The plate 30 may be used to attach tray 22 to the bracket 24 by tightening a fastener 28, such as a nut, residing beneath the plate 30 to thereby secure the plate 30 to the bracket 24. It is to be understood that the term "fastener" as used in the appended claims may refer either to bolts, screws, rivets or anchors, or to nuts or welds, or to all of the forgoing items in this sentence. The plate 30 may be an elongate member that includes a plurality of apertures or through holes formed therein and spaced within the plate 30 to correspond with the bolts 29 that extend from the tray 22*a*. When attached to the walk-on tray 22 and to the bracket 24, the plate 30 functions to more evenly distribute weight, and other forces placed on said tray 22, thereby aiding said bracket 24 in supporting the weight of the tray 22 as well as other forces placed on said tray 22. It will be appreciated that the shape of the plate 30 may be rectangular, square, elongated with or without rounded corners, oval, or any other shape suitable for distributing weight placed on the tray 22 and the bracket 24.

Attachment of the plate 30 to the bracket 24 may be accomplished by placing the plate 30 beneath the top portion 24*a* of the bracket 24, such that the plate 30 resides beneath and in proximity to the under surface 24*b*, to thereby enable the bolts 29 of the platform section 22 to extend through the holes 25 of the bracket 24, and through the holes of the attachment plate 30. Thereafter, fasteners 28, illustrated in FIGS. 2 and 3 as nuts 28, are placed on the bolts 29 and are tightened to secure the plate 30 to the bracket 24. The structure for attaching the platform sections 22 to the load-bearing upper portions 42 of the brackets 24, permits said platform sections 22 to reside in a side-by-side, sequential series and may be referred to herein as platform attachment means.

Adjustments may then be made to both the bracket 24 and the platform section 22 until all platform sections 22 are properly aligned with the pool deck. Proper alignment may be achieved when all platform sections 22 are flush with the pool deck and with each other, such that the platform sections 22 have the appearance of a finished pool deck.

Aspects of the present invention may also be described as set forth below.

DESCRIPTION OF INVENTION

A means for providing a top or "lid" for a recessed automatic-pool-cover mechanism which permits a (a) lightweight, (b) easy-to-install, (c) walk-on replication of the pool coping that surrounds the other three sides of the pool.

Details:

1. The lid system consists of a number of aluminum trays containing expanded-aluminum welded to the surface and face of the trays.

2. A ½" to ¾" layer of cement or cement epoxy or any other suitable type of mortar is poured into each tray, forming a laminated unit, matching the coping around the remaining three sides of the swimming pool.

3. The individual trays are secured to stainless-steel brackets mounted against the rear wall of the recessed cover housing by means of a plate previously fastened to the aluminum tray by tightening a bolt and nut. The installer slides the trays into place and secures the same to the stainless steel brackets by tightening the nuts on the bottom of the tray, "pinching" the plate and bracket together.

4. Brick, stone, skip-troweled and other finishes can be applied after the coping is installed or the user may prefinish the trays to match the pool coping around the other three sides of the pool.

5. This lid system can be installed on any pool with a recessed-track (undertrack), regardless of the manufacturer of the automatic cover system.

Conventional methods that have permitted the installation of a recessed pool-cover-housing lid/cover have required the use of heavy, several-inch-thick coping-trays, which are difficult to handle, labor-intensive to install, and require heavy brackets for support. The process of aligning the heavy coping stones is also time-consuming, primarily because of their weight and the heavy brackets required to support them. Typically, an installation using conventional methods takes eight to twelve hours and multiple trips to the installation site to accomplish. Since the tray/lid system of the present invention utilizes much lighter trays, the use of a coping veneer (instead of thick coping trays), and a vastly simplified means of attaching the trays to lighter-weight brackets, the entire process of installing a custom-lid system is simplified, typically reducing the installation-time to two to three hours.

Because the lid system of the present invention utilizes much lighter-weight trays and brackets, which are significantly less costly to produce than the heavier trays and brackets required of existing technology, significant savings can be achieved, using the new technology. Additionally, existing technology mandates a coping treatment (coping stones, brick, stone, cantilevered concrete, etc,) identical in composition to the coping treatment surrounding the other three sides of the pool; however, the new technology utilizes a coping veneer to cover the recessed housing, which merely replicates the coping surrounding the remaining three sides of the pool, reducing the cost of the lid system even further.

The nature of the new lid-system technology is such that walk-on lids can be easily retrofitted to existing cover-mechanism housings. The existing-technology lid system can not be retrofitted to existing pool cover housings, because of the unique housing specifications required to install the bulky, heavy tray lids.

Since the new coping lids are light weight and can easily be removed and later re-secured to the brackets designed to hold them, service and maintenance to pool cover systems with walk-on tray lids is vastly simplified and is less labor intensive.

In accordance with the features and combinations described above, a useful method of generating a veneer for concealing a pool cover operation system comprises the steps of:

(a) providing a tray having a surface for receiving a composition;

(b) providing an amount of mortar;

(c) providing an amount of resin;

(d) mixing the amount of mortar with the amount of resin forming the composition; and (e) pouring the composition onto the surface of the tray forming the veneer such that a tray of hardened cast material is simulated.

In accordance with the features and combinations described above, a useful method of installing a covering to a recess formed in a pool deck for concealing a pool cover operation system comprises the steps of:

(a) attaching a plurality of brackets to a sidewall of the recess, each bracket having a load-bearing upper portion which has a substantially horizontal orientation;

(b) positioning a plurality of platform sections onto the plurality of brackets, each platform section having a tray and at least one fastener extending downwardly through said tray;

(c) installing an attachment plate on the at least one fastener; and (d) attaching a nut to each of the at least one fastener and tightening each nut such that the load-bearing upper portion may be located between the plate and the tray of the platform section.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for concealing a pool cover operation system, said apparatus comprising:

a plurality of brackets each having a load-bearing upper portion;

bracket attachment means for attaching the brackets to a sidewall of an elongate recess such that the load-bearing upper portions of said brackets extend in a lateral orientation;

a plurality of platform sections; and an attachment plate having a top surface and a bottom surface and at least one hole formed therein, and at least one fastener for securing the attachment plate beneath the load-bearing upper portion of one of the brackets such that said attachment plate extends along a majority length of said load-bearing upper portion of said one of the brackets to thereby aid in evenly distributing loads placed on the plurality of platform sections.

2. The apparatus of claim 1, wherein the load-bearing upper portion of one of the brackets is sandwiched between an underside of one of the platform sections and the attachment plate.

3. The apparatus of claim 1, wherein the plurality of platform sections further comprise means for modifying an appearance of an upper portion of the platform sections to match an appearance of a perimeter section of a pool deck.

4. The apparatus of claim 1, wherein each of the plurality of platform sections further comprises a metal tray and a mortar veneer disposed upon said metal tray.

5. The apparatus of claim 4, wherein the mortar veneer is less than 1.0 inches thick.

6. The apparatus of claim 4, wherein the mortar veneer is less than 0.8 inches thick.

7. The apparatus of claim 4, wherein the mortar veneer is less than 0.6 inches thick.

8. The apparatus of claim 4, wherein the mortar veneer comprises a mortar-resin composition.

9. The apparatus of claim 8, wherein the mortar-resin composition comprises about 40–60% mortar.

10. The apparatus of claim 8, wherein the mortar-resin composition comprises about 40–60% resin.

11. The apparatus of claim 8, wherein the mortar-resin composition comprises a negligible amount of fiberglass particles.

12. The apparatus of claim 8, wherein the mortar-resin composition comprises fiberglass resin.

13. The apparatus of claim 1, wherein each of the plurality of brackets further comprises a longitudinal portion, wherein the brace arm is disposed between said longitudinal portion and said load-bearing upper portion for providing additional support to the load-bearing upper portion.

14. The apparatus of claim 13, wherein the brace arm is disposed at a diagonal, and said brace arm is further disposed on the longitudinal portion centrally between a plurality of holes.

15. The apparatus of claim 1, wherein each of the plurality of platform sections further comprises a bolt member attached to a tray portion of each of the plurality of platform sections such that the attachment plate may be secured to an under surface of each of the plurality of platform sections by said bolt member and said at lest one fastener.

16. The apparatus of claim 15, wherein the load-bearing upper portion of each of the plurality of brackets further comprises a plurality of sidewalls defining a plurality of apertures for permitting the bolt member to pass therethrough, wherein said attachment plate sandwiches the load-bearing upper portion between each of the platform sections.

17. The apparatus of claim 1, wherein the at least one fastener comprises at least one nut such that the attachment plate is secured to the load-bearing upper portion by said at least one nut, said at least one nut is configured and dimensioned for being located on at least one bolt member extending from each of said plurality of platform sections and for securing the attachment plate up against an under surface of each of the plurality of brackets.

18. The apparatus of claim 4, wherein the mortar veneer further comprises a base portion and a lip-engaging portion.

19. The apparatus of claim 18, wherein the lip-engaging portion extends for a length corresponding to a difference in height between a bond beam and a back portion of the elongate recess housing a pool cover retraction/placement device.

20. The apparatus of claim 4, wherein the mortar veneer further comprises a base portion having a width and a lip-engaging portion having a length, and wherein the length of the lip-engaging portion is between the range of about 10% to about 40% of the width of the base portion, and wherein the lip-engaging portion includes a lip-abutting portion, and wherein the metal tray includes a lip against which the lip-abutting portion of the lip-engaging portion abuts.

21. An apparatus for concealing a pool cover operation system, said apparatus comprising:

a bracket for attachment to a sidewall of an elongate recess comprising a lateral load-bearing portion; and a removable platform section for being attached to said bracket, said removable platform section comprising:

a tray portion having a surface; and a veneer portion having a base and a lip-engaging portion extending below said base, wherein said lip-engaging portion is configured and dimensioned for extending below a portion of a pool deck surface, wherein said veneer is disposed on said surface of said tray.

22. The apparatus of claim 21, wherein the removable platform section further comprises an attachment plate, wherein the load-bearing portion of the bracket may be sandwiched between an underside of the removable platform section and the attachment plate.

23. The apparatus of claim 21, wherein the removable platform section further comprises means for modifying an appearance of an upper portion of the removable platform section to match an appearance of a perimeter section of a pool deck.

24. The apparatus of claim 21, wherein the veneer is made from an elastic mortar that is less than 1.0 inches thick.

25. The apparatus of claim 21, wherein the veneer is made from an elastic mortar that is less than 0.8 inches thick.

26. The apparatus of claim 21, wherein the veneer is made from an elastic mortar that is less than 0.6 inches thick.

27. The apparatus of claim 21, wherein the veneer comprises a mortar-resin composition.

28. The apparatus of claim 27, wherein the mortar-resin composition comprises about 40–60% mortar.

29. The apparatus of claim 27, wherein the mortar-resin composition comprises about 40–60% resin.

30. The apparatus of claim 27, wherein the mortar-resin composition comprises a negligible amount of fiberglass particles.

31. The apparatus of claim 27, wherein the mortar-resin composition comprises fiberglass resin.

32. The apparatus of claim 21, wherein the bracket further comprises a longitudinal portion and a brace arm portion being disposed between said longitudinal portion and said load-bearing portion for providing additional support to the load-bearing portion.

33. The apparatus of claim 32, wherein the brace arm is disposed at a diagonal, and said brace arm being further disposed on the longitudinal portion centrally between a plurality of holes.

34. The apparatus of claim 21, wherein the removable platform section further comprises a fastener attached to the tray portion and an attachment plate for being secured to an under surface of the removable platform section by said fastener.

35. The apparatus of claim 34, wherein the load-bearing portion of the bracket further comprises a sidewall defining an aperture for permitting the fastener to pass therethrough, wherein said attachment plate may sandwich the load-bearing portion between the platform section.

36. The apparatus of claim 35, wherein the attachment plate is secured to the load-bearing portion by a nut, the nut being configured and dimensioned for placement on said fastener and for securing the attachment plate up against an under surface of the bracket.

37. An apparatus for concealing a pool cover operation system, said apparatus comprising:

a plurality of brackets being configured and dimensioned for being disposed on a sidewall of an elongate recess and having a load-bearing portion; and a plurality of platform sections, each platform section comprising:

a tray for attachment to the load-bearing portion of each of the plurality of brackets, the tray being configured and dimensioned with a surface; and a veneer for covering a portion of the elongate recess and being configured and dimensioned to be disposed within the surface of the tray, said veneer comprising a mortar composition, the mortar composition further comprising resin, wherein said resin provides an elastic capability allowing the mortar composition to expand and contract to thereby inhibit cracking, chipping and breaking away of the mortar composition from the tray wherein each of the plurality of platform sections further comprises an attachment plate, wherein the load-bearing portion of one of the brackets is disposed between an underside of the one of the platform sections and a top surface of the attachment plate.

38. The apparatus of claim 37, wherein each of the plurality of platform sections further comprises means for modifying an appearance of an upper portion of each of the plurality of platform sections to match an appearance of a perimeter section of a pool deck.

39. The apparatus of claim 37, wherein the veneer is less than 1.0 inches thick.

40. The apparatus of claim 37, wherein the veneer is less than 0.8 inches thick.

41. The apparatus of claim 37, wherein the veneer is less than 0.6 inches thick.

42. The apparatus of claim 37, wherein the mortar composition comprises about 40–60% mortar.

43. The apparatus of claim 37, wherein the mortar composition comprises about 40–60% resin.

44. The apparatus of claim 37, wherein the mortar composition comprises a negligible amount of fiberglass particles.

45. The apparatus of claim 37, wherein the mortar composition comprises fiberglass resin.

46. The apparatus of claim 37, wherein each of the plurality of brackets further comprises a longitudinal portion and a brace arm portion being disposed between said longitudinal portion and said load-bearing portion for providing additional support to the load-bearing portion.

47. The apparatus of claim 46, wherein the brace arm is disposed at a diagonal, and said brace arm being further disposed on the longitudinal portion centrally between a plurality of holes.

48. The apparatus of claim 37, wherein each of the plurality of platform sections further comprises a fastener attached to the tray and an attachment plate for being secured to an under surface of one of the plurality of platform sections by said fastener.

49. The apparatus of claim 48, wherein the load-bearing portion of each of the plurality of brackets further comprises at least one sidewall defining at least one aperture for permitting the fastener to pass therethrough, wherein said attachment plate may sandwich the load-bearing portion between the platform section.

50. The apparatus of claim 49, wherein the attachment plate is secured to the load-bearing portion by a at least one nut, the at least one nut being configured and dimensioned for placement on said fastener and for securing the attachment plate up against an under surface of each of the plurality of brackets.

51. An apparatus for concealing a pool cover operation system within an elongate recess, said apparatus comprising:

a tray member having a surface;

a mortar composition comprising mortar and resin; and a veneer member having an upper portion for matching an appearance of a corresponding perimeter section of a pool deck, said veneer member further having a lip-engaging portion, said lip-engaging portion extending downwardly for a length from said upper portion, said length corresponding to the difference in height between a bond beam and a back portion of the elongate recess to thereby provide an appearance that said veneer has a thickness equal to said length of said lip-engaging portion.

52. The apparatus of claim 51, wherein the veneer member includes a base portion that is less than two inches thick, and wherein the length of the lip-engaging portion is at least three inches.

53. The apparatus of claim 51, wherein the apparatus further comprises a bracket having a load-bearing portion and being configured and dimensioned for attachment onto a sidewall of the elongate recess.

54. The apparatus of claim 52, wherein the load-bearing portion has at least one hole formed therein.

55. The apparatus of claim 52, wherein the apparatus comprises a platform section and bracket attachment means for attaching the bracket to the sidewall of the elongate recess such that the load-bearing portion of said bracket extends in a substantially horizontal orientation.

56. The apparatus of claim 51, wherein the tray, the mortar composition and the veneer together comprise a platform section.

57. The apparatus of claim 55, wherein the apparatus further comprises a platform attachment means for attaching the platform section to a load-bearing upper portion of a bracket.

58. The apparatus of claim 56, wherein the platform attachment means further comprises an attachment plate, wherein the load-bearing upper portion of the bracket may be sandwiched between an underside of the platform section and the attachment plate.

59. The apparatus of claim 51, wherein the veneer further comprises means for modifying an appearance of the veneer to match an appearance of a perimeter section of a pool deck.

60. The apparatus of claim 51, wherein the veneer is less than 1.0 inches thick.

61. The apparatus of claim 51, wherein the veneer is less than 0.8 inches thick.

62. The apparatus of claim 51, wherein the veneer is less than 0.6 inches thick.

63. The apparatus of claim 51, wherein the mortar composition comprises about 40–60% mortar.

64. The apparatus of claim 51, wherein the mortar composition comprises about 40–60% resin.

65. The apparatus of claim 51, wherein the mortar composition comprises a negligible amount of fiberglass particles.

66. The apparatus of claim 51, wherein the mortar composition comprises fiberglass resin.

67. The apparatus of claim 52, wherein the bracket comprises a longitudinal portion and a brace arm portion being disposed between said longitudinal portion and said load-bearing upper portion for providing additional support to the load-bearing upper portion.

68. The apparatus of claim 67, wherein the brace arm is disposed at a diagonal, and said brace arm is further disposed on the longitudinal portion centrally between a plurality of holes.

69. The apparatus of claim 51, wherein the apparatus further comprises a fastener attached to the tray and an attachment plate for being secured to an under surface of each of the plurality of platform sections by said fastener.

70. The apparatus of claim 69, wherein the apparatus comprises a bracket having a load-bearing upper portion, wherein attachment plate is secured to the load-bearing upper portion by the fastener and a nut, said nut being configured and dimensioned for being located on said fastener and for securing the attachment plate up against an under surface of the bracket.

71. An apparatus for concealing a pool cover operation system, said apparatus comprising:

a removable platform section, said platform section comprising:

a tray member having a surface;

a veneer member having a base portion and a lip-engaging portion extending downwardly for a length from said base portion such that the lip-engaging portion extends below said base portion; and an elastic mortar composition comprising mortar and resin;

wherein the elastic mortar composition is formed on the surface of the tray member and further constitutes the veneer member, wherein the elasticity of the veneer member permits said veneer member to be between the range of 0.4 and 2 inches in thickness without cracking or chipping, and has an appearance of a segment of mortar with a thickness that corresponds substantially to the length of the lip-engaging portion.

72. An apparatus for concealing a pool cover operation system, said apparatus comprising:

at least one bracket for being disposed on a sidewall defining an elongate recess; and a platform section comprising a tray and a veneer covering a majority of an upper surface of said tray and having an upper portion and a lip-engaging portion extending downwardly from said upper portion and below said upper portion for a length such that the upper portion and the lip-engaging portion together portray an appearance of a segment of mortar having a thickness corresponding to the length of the lip-engaging portion;

wherein said upper portion may be modified to match a design of a corresponding perimeter section of a pool deck.

73. A method of installing a covering to a recess formed in a pool deck for concealing a pool cover operation system comprises the steps of:

(a) attaching a plurality of brackets to a sidewall of the recess, each bracket having a load-bearing upper portion which has a substantially horizontal orientation;

(b) positioning a plurality of platform sections onto the plurality of brackets, each platform section having a tray and at least one fastener extending downwardly through said tray;

(c) installing an attachment plate on the at least one fastener; and (d) attaching a nut to each of the at least one fastener and tightening each nut such that the load-bearing upper portion may be located between the plate and the tray of the platform section.

74. An apparatus for concealing a pool cover operation system, said apparatus comprising:

a plurality of brackets each having a load-bearing upper portion;

bracket attachment means for attaching the brackets to a sidewall of an elongate recess such that the load-bearing upper portions of said brackets extend in a lateral orientation;

a plurality of platform sections; and an attachment plate having a top surface and a bottom surface and at least one hole formed therein, and at least one fastener for securing the attachment plate to the load-bearing upper portion of one of the brackets such that said attachment plate aids in evenly distributing loads placed on the plurality of platform sections, wherein the load-bearing upper portion of on of the brackets is disposed between an underside of one of the platform sections and said top surface of the attachment plate.

* * * * *